US005493168A

United States Patent [19]

Seedorf

[11] Patent Number: 5,493,168

[45] Date of Patent: Feb. 20, 1996

[54] ELECTRIC LAMP SUBJECT TO HIGH OPERATING TEMPERATURES

[75] Inventor: Ralf Seedorf, Berlin, Germany

[73] Assignee: Patent-Treuhand-Gesellschaft F. Elektrische Gluehlampen mbH, Munich, Germany

[21] Appl. No.: 51,047

[22] Filed: Apr. 21, 1993

[30] Foreign Application Priority Data

May 11, 1992 [DE] Germany ..... 92 06 314.4

[51] Int. Cl.[6] ..... H01J 7/26; H01J 1/02

[52] U.S. Cl. ..... 313/35; 313/11; 313/30; 313/43

[58] Field of Search ..... 313/37, 35, 30, 313/43, 42, 34

[56] References Cited

U.S. PATENT DOCUMENTS

| | | | |
|---|---|---|---|
| 2,558,357 | 6/1951 | Grimm | 313/30 |
| 3,978,361 | 8/1976 | Hiramoto | 313/35 |
| 3,989,983 | 11/1976 | Uchino et al. | 315/248 |
| 4,023,060 | 5/1977 | Pike et al. | 313/273 |
| 4,290,097 | 9/1981 | Block et al. . | |
| 4,405,882 | 9/1983 | Reinsch . | |
| 4,550,269 | 10/1985 | Dixon | 313/331 |
| 4,682,071 | 7/1987 | Thorpe | 313/43 |
| 4,695,757 | 9/1987 | Ury et al. | 313/44 |
| 4,967,330 | 10/1990 | Bell et al. . | |

FOREIGN PATENT DOCUMENTS

| | | |
|---|---|---|
| 0184867 | 6/1986 | European Pat. Off. . |
| 0455295A1 | 11/1991 | European Pat. Off. . |

*Primary Examiner*—Donald J. Yusko
*Assistant Examiner*—Lawrence O. Richardson
*Attorney, Agent, or Firm*—Frishauf, Holtz, Goodman, Langer & Chick

[57] ABSTRACT

To prevent corrosion of molybdenum connecting pins or wires extending from melt-sealed ends of high-power lamps, the region immediately adjacent the exit points from the melt-sealed end are cooled by a cooling gas, for example air or an inert gas such as nitrogen. The cooling gas is applied by cooling ducts which are made of metal and, simultaneously, provide for electrical connection of electrical energy to the connecting leads. Cooling gas can be introduced either through terminal pins or rods into the tubular elements, or the tubular elements can be connected, as usual, to the part-solid terminal pins or rods and additional gas connections are passed through the base through the tubular elements to supply cooling gas.

12 Claims, 3 Drawing Sheets

ELECTRIC LAMP SUBJECT TO HIGH OPERATING TEMPERATURES

Reference to related publication:

European Published Application 184 867, Mewissen.

FIELD OF THE INVENTION

The present invention relates to electric lamps, and more particularly to electric lamps of power ratings, for example in the kilowatt range, in which melt-sealed connections through ends of the bulb are made with foils, typically molybdenum foils, and connecting elements are used which are subject to oxidation under elevated temperatures.

BACKGROUND

Lamps of the type to which the present invention relate may be incandescent lamps, usually halogen incandescent lamps, having a quartz-glass bulb; the invention is equally applicable to high-pressure discharge lamps with discharge vessels made of quartz glass. The lamp bulb, or the discharge vessel, respectively, are closed and sealed by metal foils, typically molybdenum foils, which are melt-sealed in one or two portions of the bulb. Electrical energy is supplied to the electrodes through these metal foils. Externally extending connection leads, typically pins or wires, are welded to the metal foils and pass through the outer ends of the melt seals.

High-power halogen incandescent lamps, as well as high-pressure discharge lamps, in operation, generate high temperatures. The metal foils, melt-sealed to the bulb or discharge vessel, are then also subjected to high temperatures. With these high temperatures, particularly weld connections between the metal foils and the externally extending current supply leads are subject to oxidation which may become high under the high temperature operating conditions.

The lamp parts which are subject to high temperatures are frequently surrounded by an external envelope or vessel. Thus, the actual light source, that is the discharge vessel, is located within the outer envelope. The envelope can be evacuated or filled with an inert gas.

Enhanced cooling has previously been suggested with respect to highly loaded halogen incandescent lamps, for example of the type described in the referenced European Application 184,867, Mewissen. The lamp is a double-ended lamp which has two pinch seals at respective ends. The pinch seals are kept at a lower temperature by a metal envelope, which surrounds the pinch seal with space between. The base is filled with a heat-conducting mass, such as steel wool or other metal fibers. This cooling, thus, surrounds the pinch seals and hence the melt-sealed connecting foils.

Surrounding the pinch seals with an outer metal casing, filled with metallic fibers or filaments, or providing an outer envelope, substantially increases the overall size of the lamp. This increase in size reduces the applicability of the lamp for numerous uses.

THE INVENTION

It is an object to provide an electric lamp with improved protection with respect to oxidation of connecting elements and the melt-sealed metal foils.

Briefly, the connecting leads extending from the melt seals are electrically connected to the terminals by further electrical connectors which are tubular, and through which a cooling gas can be passed. The tubular connectors provide a stream of cooling gas against the immediate vicinity of the ends of the lamp, that is, the ends of the melt seals. Thus, oxidation at the current supply leads and the sealed metal foils is effectively prevented since the temperature is substantially reduced.

In accordance with a feature of the invention, the gas is so conducted to the end portions of the lamp that only the ends, that is the terminal regions of the seals, are cooled. Thus, the halogen cycle which, if the lamp is a halogen lamp, occurs within the lamp bulb, is not interfered with by excessive cooling; likewise, the appropriate vaporization of the fill in a gas discharge tube is not interfered with, so that all components of the fill can provide the desired and intended radiation spectra.

The cooling arrangement in accordance with the present invention permits compact construction of the lamp, since the external dimensions of the lamp are not changed, and no external envelope or second bulb is needed. The tubular connectors at the same time provide electrical energy to the current supply leads extending from the melt seal, may be part of connecting pins, or connected to solid connecting pins or posts.

In accordance with a desirable feature of the invention, a glass frit or glass solder is used, applied to the connecting leads, or connecting pins, extending from the melt seals, to seal the terminal end and transition point between the end of the melt seal and the extending connecting lead. This provides additional protection against oxidation of the melt-sealed metal foils, and particularly for the weld points between the metal foils and the externally extending connecting leads, typically metallic pins.

DRAWING

DETAILED DESCRIPTION

For purposes of illustration, the lamp is shown as a single-based, double-ended lamp, although the invention is also applicable to a single-ended lamp.

Figure 1:
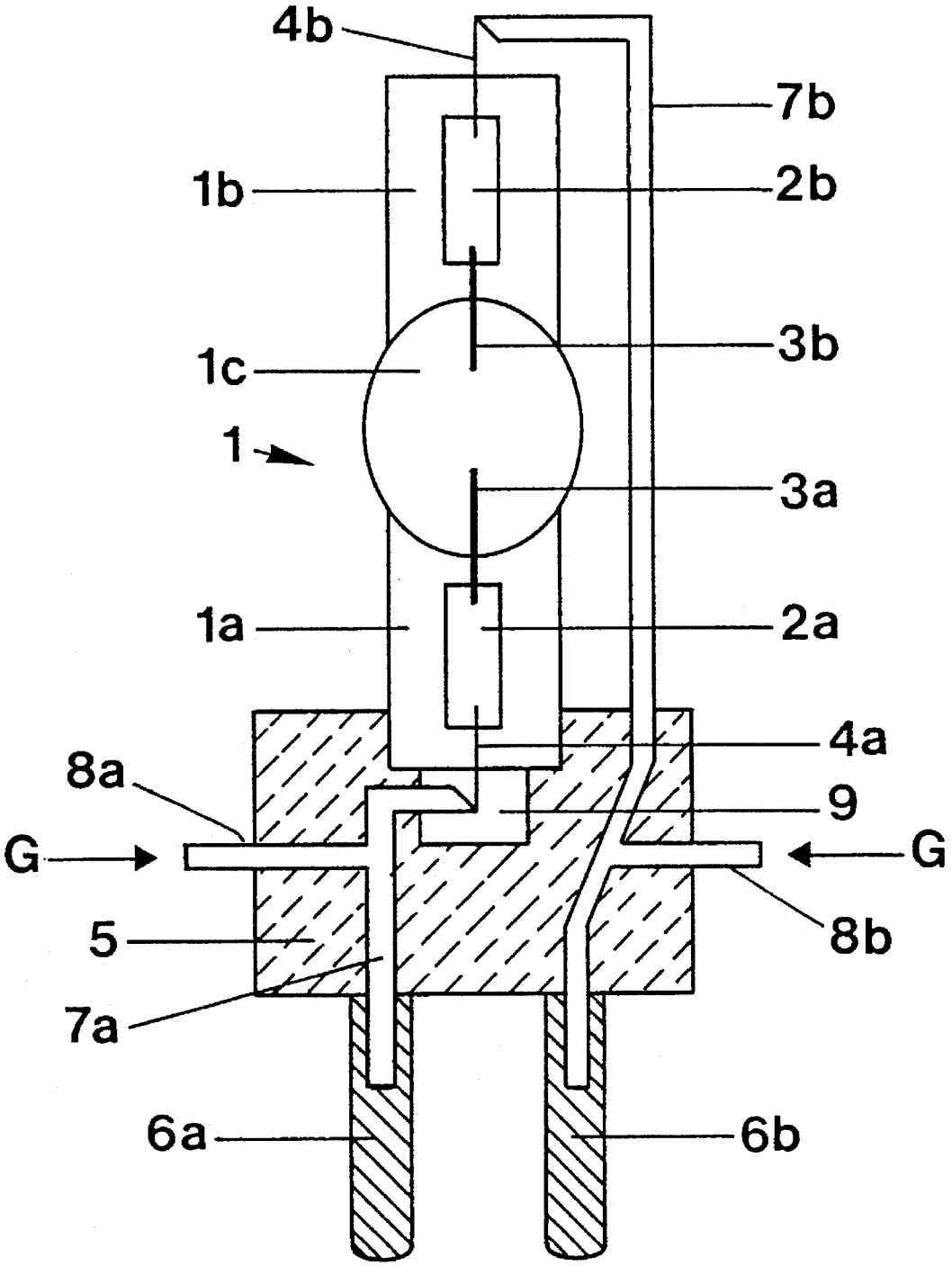
FIG. 1 is a highly schematic side view of a single-based, double-ended high-pressure discharge lamp, in which the base is shown in section.

Referring first to FIG. 1:

A double-ended, single-based high-pressure discharge lamp has a discharge vessel 1 of quartz glass with two diametrically opposite end portions 1*a*, 1*b*, in each of which a molybdenum foil 2*a*, 2*b* is melt-sealed in a gas-tight manner. Tungsten electrodes 3*a*, 3*b* are welded to the molybdenum foils 2*a*, 2*b* at one end, and connecting pins 4*a*, 4*b* of molybdenum are welded to the foils 2*a*, 2*b* at the other end. The connecting pins 4*a*, 4*b* extend outside of the respective melt seals 1*a*, 1*b*. The discharge vessel 1 is secured in a base 5 made of ceramic material, of the type G22. The base 5 has two metallic contact pins 6*a*, 6*b* to supply electrical energy to the lamp. Current supply extends from the connecting pins or posts 6*a*, 6*b* to the end pins 4*a*, 4*b* extending from the electrodes 3*a*, 3*b* via the molybdenum foils 2*a*, 2*b*.

In accordance with a feature of the invention, the connecting structure for electrically connecting the pins 6a, 6b to the connecting leads 4a, 4b is formed by tubular current supplies 7a, 7b. The tubular current supplies 7a, 7b are welded to the projecting ends of the respective molybdenum pin or post 4a, 4b and are guided through the base 5 to the contact pins 6a, 6b, to which they are welded or soldered. The pins or posts 6a, 6b are formed with openings into which the ends of the respective current connectors 7a, 7b are fitted. The base is designed to accommodate the tubular connectors 7a, 7b.

Two cooling gas connections 8a, 8b are connected to the hollow connectors 7a, 7b. The cooling connections are located within the base 5.

The tubular current supply connectors 7a, 7b, and preferably also the stubs 8a, 8b, are made, preferably, of nickel. If the lamp is, for example, a 1.2 kW high-pressure discharge lamp, the current connectors 7a, 7b have an external diameter of about 3 mm and a wall thickness of about 0.5 mm. In accordance with a feature of the invention, the terminal portions of the connectors 7a, 7b are so shaped at their connection points to the molybdenum pins 4a, 4b that a stream of cooling gas, schematically shown by arrows G is directed towards the ends 1a, 1b of the lamp 1 and, especially, towards the end portions of the ends, where the pins 4a, 4b exit from the melt seals 1a, 1b.

The base 5 is formed with a vent opening 9 to permit the cooling gas stream from the connector 7a to vent to the outside.

The cooling gas is preferably air or nitrogen. The gas G is introduced by a blower—not shown—through the connections 8a, 8b and the hollow current supply connectors 7a, 7b and directed towards the ends 1a, 1b of the discharge bulb. 1. The end portions of connectors 7a, 7b therefore function both as current supply junctions and air direction nozzles.

Figure 2:
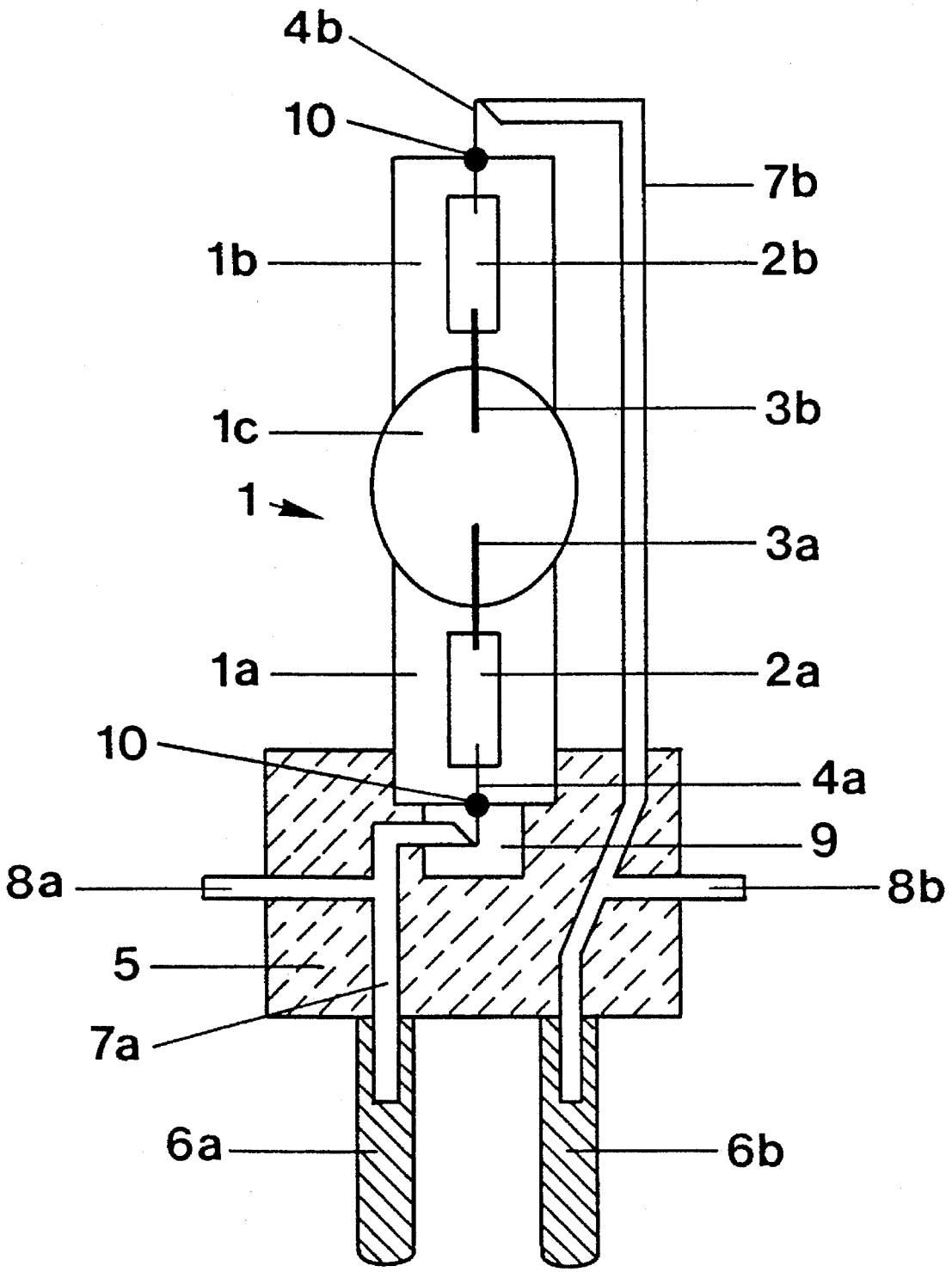
FIG. 2 is a view similar to FIG. 1 and illustrating another embodiment.

FIG. 2 illustrates another embodiment, which is essentially similar to that shown in FIG. 1 and the same reference numerals have been used throughout. In addition to the features described in connection with FIG. 1, a glass frit or glass solder 10 is placed at the exit points of the connecting leads 4a, 4b from the frit or solder seals 1a, 1b. This glass melt 10 provides a seal, and provides protection for the weld points between the molybdenum foil 2a, 2b and the molybdenum pins 4a, 4b; these weld points are particularly subject to corrosion; the glass melt seals 10 provide additional protection with respect to oxidation of the weld points.

Figure 3:
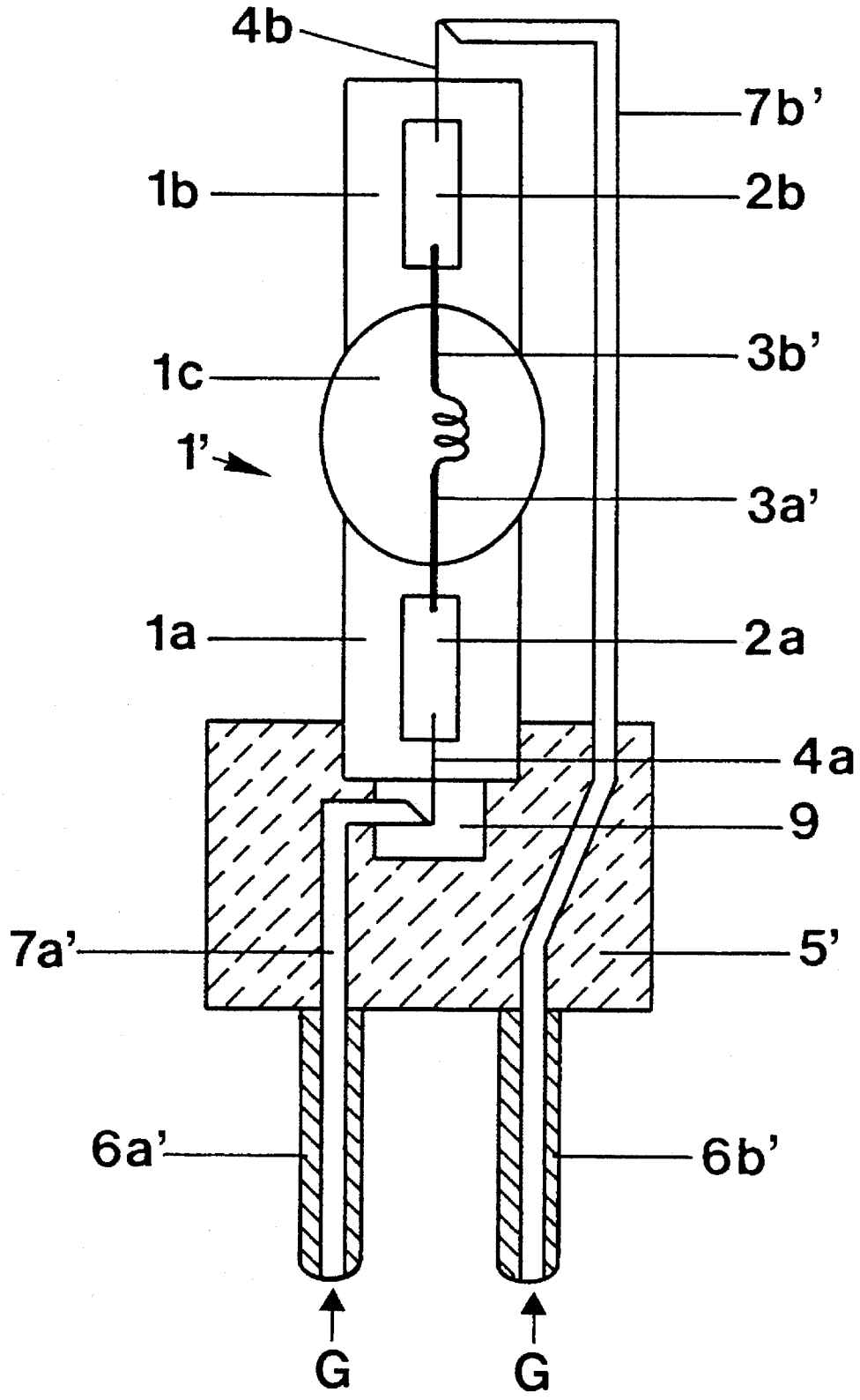
FIG. 3 is a view similar to FIG. 1, and illustrating yet another embodiment and, further, application of the invention to the halogen incandescent lamp.

FIG. 3 illustrates a lamp similar to that shown in FIGS. 1 and 2, except that here the lamp is an incandescent lamp, typically a halogen incandescent lamp. The lamp has a lamp bulb 1', in which electrodes 3a', 3b' are located, connected by a filament as shown only schematically, and as otherwise well known.

FIG. 3 further illustrates another difference between the embodiments previously described. The lamp base 5' does not have any laterally placed cooling gas connectors as shown in the embodiments of FIG. 1 and 2; rather, cooling gas is supplied through hollow connecting pins or posts 6a', 6b' which extend from the lamp base 5'. Thus, the connectors 7a', 7b' can extend all the way through the connecting posts 6a', 6b' secured thereto for example by welding or soldering. They can terminate at the end, as shown at FIG. 3, or short of the end portions of the pins 6a', 6'.

The connecting posts 6a', 6b' thus have a dual function: they supply electrical energy as well as provide a path for cooling gas to cool the lamp bulb or, if the lamp is a discharge lamp, the discharge vessel. The cooling gas, preferably, is air; otherwise, an inert gas such as, for example, nitrogen can be used, the gas being supplied by a blower (not shown) into the lamp socket for connection to the interior of the connecting pins or posts 6a', 6b'.

The invention is not restricted to the embodiments illustrated. It may be used also with other thermally highly loaded single-based halogen lamps, such as halogen incandescent lamps as shown in FIG. 3. With slight modification, the invention may likewise be used for double-based electric lamps, such as high-pressure discharge lamps or halogen incandescent lamps. In that case, the connections to the respective terminals 4a, 4a', 4b , 4b' will be roughly similar to those illustrated in connection with the connectors 7a, 7a'.

The tubular current supply leads need not be made of nickel; other heat-resistant metals, such as high-quality steel, may be used. The dimensions of the cooling gas—electrical energy supply connectors are not critical. The external diameter can vary in respective embodiments between about 2 to 4 mm, and within wider ranges; the wall thickness of the tubular connectors may be between about 0.4 to 1 mm.

Various changes and modifications may be made, and any features described herein with respect to any embodiment may be used with any other embodiments, within the scope of the inventive concept.

I claim:

1. High-power electric lamp having a lamp bulb (1, 1') having at least one melt-seal end (1a, 1b);

two metal foils (2a, 2b) and two electrical connecting leads, one each (4a, 4b) electrically connected to each of the foils and extending outwardly of the bulb, and melt-sealed to the at least one melt-seal end (1a, 1b), a lamp base (5, 5'), electrical connection terminals (6a, 6b, 6a', 6b') for connecting the lamp to a source of electrical energy;

connection means (7a, 7b, 7a', 7b') fitted in the base and electrically connecting said connection leads (4a, 4b) and said terminals and wherein, the base (5, 5') includes cooling gas connections (6a', 6b', 8a, 8b); and wherein the connection means (7a, 7b, 7a', 7b') comprises tubular elements terminating close to the at least one melt-seal end (1a, 1b) of the lamp bulb with the metal foils melt-sealed therein and pneumatically coupled to said cooling gas connections (6a', 6b', 8a, 8b), for directing a stream of cooling gas (G) to said at least one melt-seal end with the metal foil melt-sealed therein, and to adjacent portions of the respective connecting lead (4a, 4b).

2. The lamp of claim 1, further including a glass frit or glass solder (10) sealing the respective melt-sealed end (1a, 1b) of the lamp bulb in the region of the connecting lead (4a, 4b) extending outwardly of said melt-sealed end.

3. The lamp of claim 1, wherein said electrical connection terminals are at least partly hollow, and said tubular elements are fitted into the part-hollow portion and electrically connected to said connection terminals thereat.

4. The lamp of claim 1, wherein said electrical connection terminals (6a', 6b') are hollow throughout, and pneumatically as well as electrically connected to said tubular elements forming said connection means, to provide for application of cooling gas through the connection terminals to the melt-sealed ends (1a, 1b) of the lamp.

5. The lamp of claim 1, further including gas connection ducts (8a, 8b) extending from an outer surface of the base to said tubular elements (7*a*, 7*b*) and pneumatically connected to said tubular elements to provide for coupling of cooling gas to said tubular elements.

6. The lamp of claim 1, wherein the bulb comprises a single-based compact high-pressure discharge lamp, devoid of an outer envelope.

7. The lamp of claim 1, wherein said lamp comprises a single-based halogen cycle incandescent lamp.

8. The lamp of claim 1, wherein said connecting leads (4*a*, 4*b*) extending from said metal sealing foils outside of the melt-sealed end comprise molybdenum pins or wires.

9. The lamp of claim 1, wherein the at least one melt-sealed end (1*a*, 1*b*) is seated within the base (5); and wherein said base is formed with a vent opening (9) adjacent the outer terminal end of the melt-sealed end (1*a*, 1*b*) within the base to provide for venting of cooling gas applied to said end.

10. The lamp of claim 1, wherein the lamp bulb (1, 1') and the base (5), each, are discrete elements, fitted and secured together; and wherein the at least one connection means (7*a*, 7*a'*, 7*b*, 7*b'*) is located, at least in part, within the base.

11. The lamp of claim 8, wherein the base comprises ceramic material.

12. The lamp of claim 1, wherein the lamp bulb is double-ended, defining two melt-seal ends (1*e*, 1*b*);

wherein the tubular connection means coupled to said pneumatical cooling gas connection (6*a'*, 6*b'*; 8*a*, 8*b*) comprises two connection tubes, one (7*a*, 7*a'*) of said tubes terminating close to one melt-seal end (1*a*), and the other (7*b*, 7*b'*) of said tubes terminating close to the other melt-seal end (1*b*); and one of said melt-seal ends (1*a*) is seated in and secured to said base (5).

* * * * *